US005497853A

United States Patent [19]

Collins, Jr. et al.

[11] Patent Number: 5,497,853

[45] Date of Patent: Mar. 12, 1996

[54] LABOR-SAVING CONSOLIDATED CHECKOUT SYSTEM

[75] Inventors: Donald A. Collins, Jr.; Andrew B. Nye, III, both of Duluth, Ga.

[73] Assignee: NCR Corporation, Dayton, Ohio

[21] Appl. No.: 898,648

[22] Filed: Jun. 15, 1992

[51] Int. Cl.[6] ..... A47F 9/02

[52] U.S. Cl. ..... 186/61; 235/383

[58] Field of Search ..... 186/61–69; 235/383

[56] References Cited

U.S. PATENT DOCUMENTS

| | | | |
|---|---|---|---|
| 4,236,604 | 12/1980 | Warner | 186/61 |
| 4,353,564 | 10/1982 | Joseloff | 186/63 X |
| 4,676,343 | 6/1987 | Humble et al. | 186/61 |
| 4,775,782 | 10/1988 | Mergenthaler et al. | 186/61 X |
| 4,964,053 | 10/1990 | Humble | 364/466 |
| 5,178,234 | 1/1993 | Sakurai et al. | 186/61 |

*Primary Examiner*—F. J. Bartuska
*Attorney, Agent, or Firm*—Paul W. Martin

[57] ABSTRACT

A labor-saving consolidated checkout system which requires a single store employee and which is suited for self-service and full-service operation. The system includes first and second joined checkout counters which include first and second terminals at one end of the counters. The checkout counters may additionally include first and second conveyor belts. Each terminal has an optical scanner and a magnetic stripe reader which are accessible to a customer. Each terminal also includes a keyboard and a cash drawer. The store employee monitors self-service customers to ensure that all merchandise items are scanned and payment is made and assists full-service customers with scanning and payment.

11 Claims, 2 Drawing Sheets

LABOR-SAVING CONSOLIDATED CHECKOUT SYSTEM

BACKGROUND OF THE INVENTION

The present invention relates to point-of-service checkout systems and more specifically to a labor-saving consolidated checkout system.

Labor is a major cost in most point-of-service environments, such as retail and grocery establishments. In fact, labor costs may account for as much as eighty percent of the cost of completing a sale. On the other hand, equipment costs may reach only about five percent of the cost of completing a sale.

Traditionally, checkout systems have included islands for servicing one lane and one customer per island at a time. Such systems have included scanners at the end of a conveyor belt and a point-of-service terminal, separated from the scanner and located in front of the point-of-service operator. These systems have been limited to full-service operation, which requires that each island be manned by at least a point-of service operator or checkout clerk. Such systems are costly to operate and lack flexibility in that they are not equipped to handle self-service customers.

U.S. Pat. No. 4,676,343 entitled, "Self-Service Distribution System", issued Jun. 30, 1987, to Humble et al., discloses a self-service distribution system including a plurality of separate checkout counters, each checkout counter including an optical scanner and a self-service customer display at a first end and a bagging area at the other end. Security is provided through gates between the checkout counters and tunnels over the conveyor belts. A retail terminal and a single store employee are located separately from the checkout counters and provide payment assistance for four checkout lanes.

The system disclosed by Humble et al. suffers from the disadvantage that it is suited for only self-service customers. The point-of-service scanner is located on the opposite side of the gate from the store associate. Also, the store associate is located at a retail terminal away from the bagging end of the checkout lane. The system of Humble et al. also suffers from the problem that the checkout lanes are divided, and spread apart, giving the store associate problems with security.

Therefore, it would be desirable to provide a labor-saving checkout system which is suitable for self-service as well as store-assisted operation, and which includes an integral point-of-service device where all elements of the checkout process may be completed.

SUMMARY OF THE INVENTION

In accordance with the teachings of the present invention, a labor-saving consolidated checkout system is provided. The system includes first and second joined checkout counters which include first and second terminals at one end of the counters. The checkout counters may additionally include first and second conveyor belts. Each terminal has an optical scanner and a magnetic stripe reader which are accessible to a customer. Each terminal also includes a keyboard and a cash drawer. The store employee monitors self-service customers to ensure that all merchandise items are scanned and payment is made and assists full-service customers with scanning and payment.

It is accordingly an object of the present invention to provide a labor-saving consolidated checkout system.

It is another object of the present invention to provide a labor-saving consolidated checkout system which facilitates full service as well as self-service operations.

It is another object of the present invention to provide a labor-saving consolidated checkout system in which a store associate is available at the end of a checkout counter to watch up to two lanes and provide full service assistance and theft deterrence.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
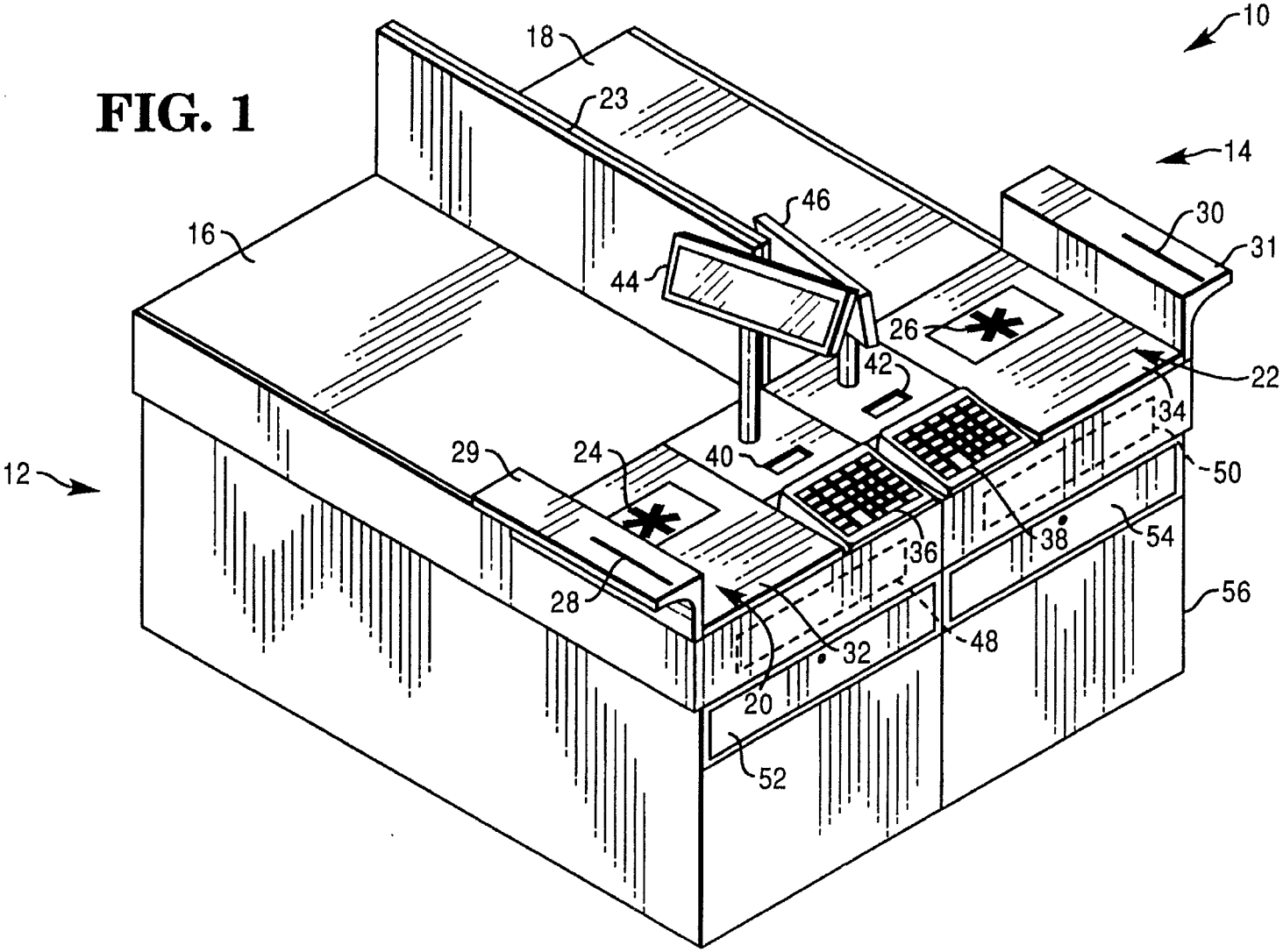
FIG. 1 is a perspective view of the checkout system of the present invention.

Referring now to FIG. 1, system 10 of the present invention includes checkout counters 12 and 14 for processing two customers at the same time. Checkout counters 12 and 14 are substantially mirror images of each other and are located adjacent one another to form a single island in a typical point-of-service environment.

Checkout counters 12 and 14 include parallel conveyor belts 16 and 18 and point-of-service terminals 20 and 22. Conveyor belts 16 and 18 support and transport merchandise items. Wall 23 separates checkout counters 12 and 14.

Point-of-service terminals 20 and 22 are located at the end of conveyor belts 16 and 18 and include optical scanners 24 and 26, magnetic strip readers 28 and 30, scales 32 and 34, keyboards 36 and 38, keyboard displays 40 and 42, customer displays 44 and 46, terminal electronics 48 and 50, and cash drawers 52 and 54. Magnetic stripe readers 28 and 30 are mounted within writing surfaces 29 and 31. It is a feature of the present invention that these terminal components are integrally housed together at end 56 of checkout counters 12 and 14, within easy reach of both a customer and a store employee.

Figure 2:
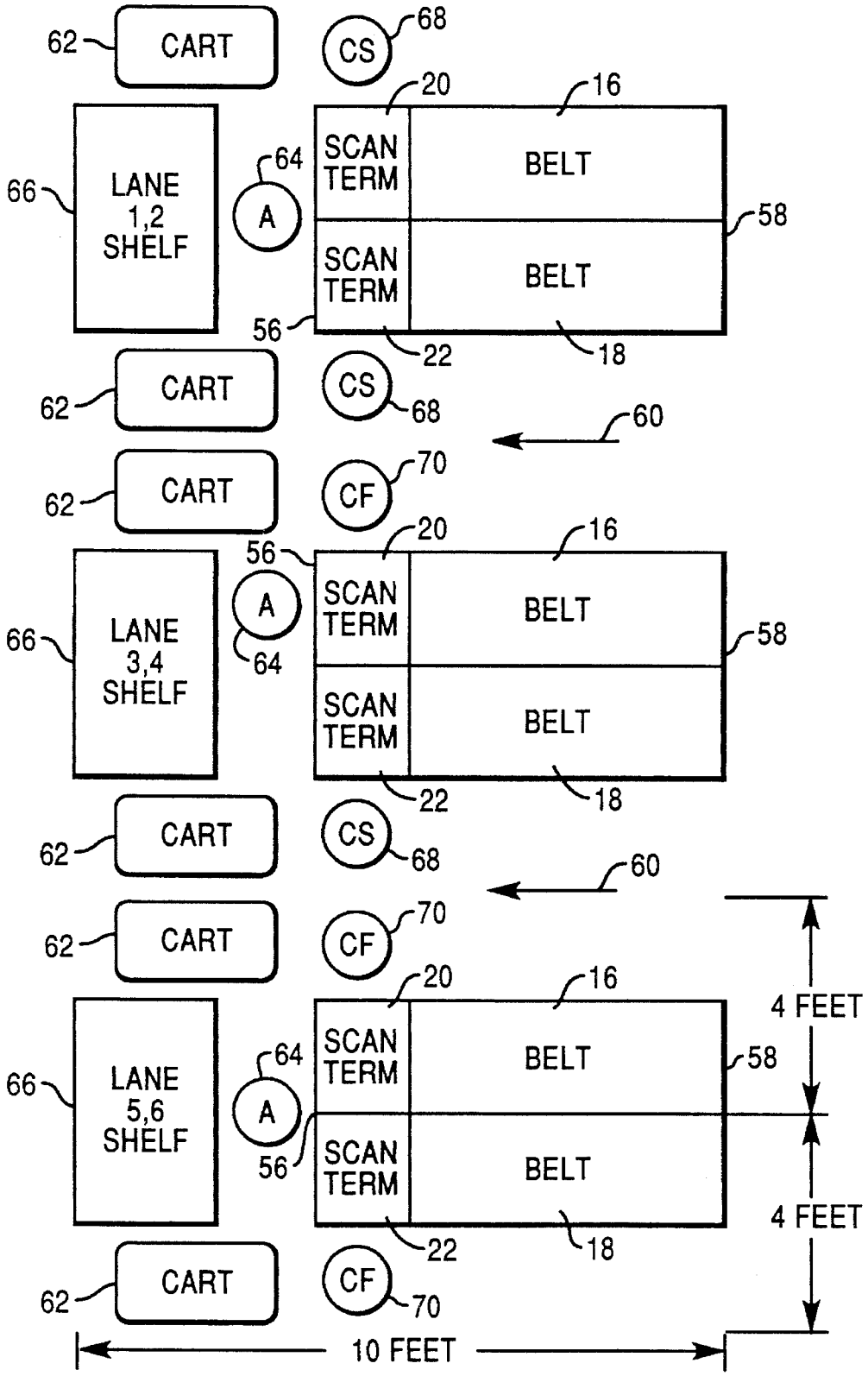
FIG. 2 is a block diagram of a plurality of the checkout systems of FIG. 1 arranged in a labor-saving configuration.

Turning now to FIG. 2, a plurality of systems 10 are arranged in a retail environment. Each system 10 is separated by an aisle 60 whose width is dependent upon the available floor space and the number of systems 10. Preferably, each aisle 60 is wide enough to pass at least two customers and their carts 62. Store checkout personnel 64 (shown as an "A" within a circle) are located at end 56 adjacent terminals 20 and 22. Lane shelves 66 may also be provided on the other side of checkout personnel 64.

Customers desiring to checkout enter at end 56, although system 10 may also be oriented so that entry is made at end 58. System 10 is designed to handle any combination of full and self-service customers, although preferred operation includes two self-service customers 68 (shown as letters "CS" within a circle), or one self-service customer 68 and one full-service customer 70 (shown as letters "CF" within a circle).

Thus, self-service customer 68 reads the instructions on customer display 44 or 46, scans merchandise items over scanner 24 or 26, deposits the merchandise items on conveyor belt 16 or 18, bags merchandise items, and pays for the items. Payment is preferably made using a credit or debit card, which self-service customer 68 swipes through magnetic strip reader 28 or 30, although payment may also be made with cash or check. Coupons may also be accepted by retail operator 64. After payment is made, customer 68 bags scanned merchandise items, which have traveled to end 58.

If entry is made at end 58, self-service customer 68 unloads cart 62 by placing merchandise items on conveyor belt 16 or 18, moves cart 62 to a position adjacent terminal 20 or 22, scans merchandise items over scanner 24 or 26, deposits the merchandise items in bags within cart 62, and pays for the items.

During self-service operations, retail operator 64 provides a theft deterrent by monitoring customer 68 to ensure that a valid scan indication is received for all merchandise items and that payment is made. Retail operator 64 is also available to assist self-service customer 68, if necessary.

After entering aisle 60, full-service customer 70 waits for retail operator 64 to scan and bag merchandise items. Payment is preferably made using a credit or debit card, which self-service customer 68 swipes through magnetic strip reader 30, although payment may also be made with cash or check. Coupons may also be accepted by retail operator 64.

Advantageously, system 10 provides an ergonomically superior arrangement for the checkout process. The consolidated hardware solution provides a self-service option while preserving full-service checkout capability. No modification is needed to convert from self-service to full-service or back again. Finally, it requires about a third less floor space than traditional checkout systems.

What is claimed is:

1. A checkout system comprising:

a first checkout counter including a first integrated terminal at one end of the first checkout counter, the first terminal including a first optical scanner mounted within the first checkout counter and located on an outer side of the first checkout counter, and a first keyboard located on an inner side of the first checkout counter; and a second checkout counter joined to the first checkout counter including a second integrated terminal at one end of the second checkout counter adjacent the first terminal, the second terminal including a second optical scanner mounted within the second checkout counter and located on an outer side of the second checkout counter, and a second keyboard located on an inner side of the second checkout counter;

wherein the first and second optical scanners are the only optical scanners in the first and second checkout counters and are operable by a self-service customer adjacent the outer side of either the first or second checkout counter or by a store employee adjacent the one end of either the first or second checkout counter for a full-service customer.

2. The checkout system as recited in claim 1, wherein each terminal further comprises:

a display oriented vertically on the terminal for viewing by a customer.

3. The checkout system as recited in claim 1, wherein each terminal further comprises:

a writing table on the outer side of each checkout counter.

4. The checkout system as recited in claim 1, wherein each terminal further comprises:

a magnetic stripe reader at the one end of the checkout counter.

5. The checkout system as recited in claim 3, wherein each writing table further comprises:

a magnetic stripe reader.

6. The checkout system as recited in claim 1, wherein each terminal further comprises a cash drawer at the one end of each checkout counter.

7. A checkout system comprising:

a first checkout counter including a first conveyor belt on top of the first checkout counter for carrying merchandise items, and a first integrated terminal at the one end of the first checkout counter including a first optical scanner mounted within the first checkout counter and located on an outer side of the first checkout counter, a first keyboard located on an inner side of the first checkout counter adjacent the first optical scanner, a first magnetic stripe reader located on the outer side of the first checkout counter, a first cash drawer at the one end of the first checkout counter, a first writing table located on the outer side of the first checkout counter facing a first aisle, and a first display vertically oriented for viewing by a customer;

a second checkout counter joined to the first checkout counter including a second conveyor belt on top of the second checkout counter for carrying merchandise items, and a second integrated terminal at the one end of the second checkout counter including a second optical scanner mounted within the second checkout counter and located on an outer side of the second checkout counter, a second keyboard located on an inner side of the second checkout counter adjacent the second optical scanner, a second magnetic stripe reader located on the outer side of the second checkout counter, a second cash drawer at the one end of the second checkout counter, a second writing table located on the outer side of the second checkout counter facing a second aisle, and a second display vertically oriented for viewing by a customer; and a wall for separating the first checkout counter from the second checkout counter;

the first and second optical scanners being operable by a self-service customer adjacent the outer side of either the first or second checkout counter or by a store employee adjacent the one end of either the first or second checkout counter for a full-service customer.

8. A checkout method comprising the steps of:

providing first and second joined checkout counters, the first and second checkout counters including first and second integrated terminals at one end of the first and second checkout counters having first and second optical scanners mounted within the first and second checkout counters and first and second magnetic stripe readers which are accessible to a self-service customer and a store employee, wherein the first and second optical scanners are the only optical scanners at the first and second checkout counters;

scanning merchandise items by the first optical scanner at the first checkout counter without assistance from the store employee;

reading information by the first magnetic stripe reader from a card swiped through the first magnetic stripe reader to accept payment for the items without assistance from the store employee;

transporting the items from the store by the self-service customer without assistance from the store employee; and monitoring the scanning and payment steps by the store employee at the first checkout counter to ensure that all of the items are scanned and payment is received.

9. The method as recited in claim 8, further comprising the steps of:

scanning merchandise items by the second optical scanner at the second checkout counter with assistance from the store employee;

indexing payment information into a keyboard at the second terminal with assistance from the store employee.

10. The method as recited in claim 8, further comprising the steps of:

scanning merchandise items by the second optical scanner at the second checkout counter without assistance from the store employee;

reading information by the second magnetic strip reader from a card swiped through the second magnetic stripe reader to accept payment for the items without assistance from the store employee;

transporting the items from the store by the self-service customer without assistance from the store employee; and monitoring the scanning and payment steps by the store employee at the second checkout counter to ensure that all of the items are scanned and payment is received.

11. A checkout method employed in an establishment having first and second joined checkout counters including first and second integrated terminals at one end of the first and second checkout counters having first and second optical scanners mounted within the first and second checkout counters and first and second magnetic stripe readers which are accessible to first and second self-service customers and a store employee, wherein the first and second optical scanners are the only optical scanners in the checkout system, the method comprising the steps of:

stationing the store employee at or adjacent the one end of the first and second checkout counters;

independently scanning purchased merchandise items by said first and second self-service customers at the first and second checkout counters to determine the payment amounts due for the purchased merchandise items;

independently paying for the purchased merchandise items using payment cards swiped through the first and second magnetic stripe readers by the first and second self-service customers; and scrutinizing both the first and second customers by the store employee as the first and second self-service customers perform the steps of scanning and paying to ensure that all of the items are scanned and that payment is received.

* * * * *